United States Patent [19]

Vollers

[11] 4,164,134

[45] Aug. 14, 1979

[54] METHOD OF MANUFACTURING A METALLIC BELT OF HIGH STRENGTH, AND APPARATUS FOR USE IN SAID METHOD

[75] Inventor: Evert J. Vollers, Haaren, Netherlands

[73] Assignee: Van Doorne's Transmissie B.V., Tilburg, Netherlands

[21] Appl. No.: 823,721

[22] Filed: Aug. 11, 1977

[30] Foreign Application Priority Data

Aug. 20, 1976 [NL] Netherlands ..... 7609297

[51] Int. Cl.[2] ..... B21D 53/14

[52] U.S. Cl. ..... 72/183; 72/168

[58] Field of Search ..... 72/183, 168, 205, 160, 72/166; 140/161, 108; 29/159 R

[56] References Cited

U.S. PATENT DOCUMENTS

| | | | |
|---|---|---|---|
| 2,760,546 | 8/1956 | Lorig | 72/183 X |
| 3,540,252 | 11/1970 | Pfanner | 72/166 |
| 3,545,243 | 12/1970 | Ungerer et al. | 72/160 |

*Primary Examiner*—Milton S. Mehr

*Attorney, Agent, or Firm*—Weingarten, Maxham & Schurgin

[57] ABSTRACT

A method of manufacturing an endless metallic belt of high strength for use as a drive belt or a part of a drive belt. A stress gradient is introduced in the belt in the radial direction thereof by bending the belt at such a radius as to produce plastic deformation of the metal. The belt is first subjected to tensile stress, which stress is maintained during the bending process.

5 Claims, 5 Drawing Figures

Figure 1:
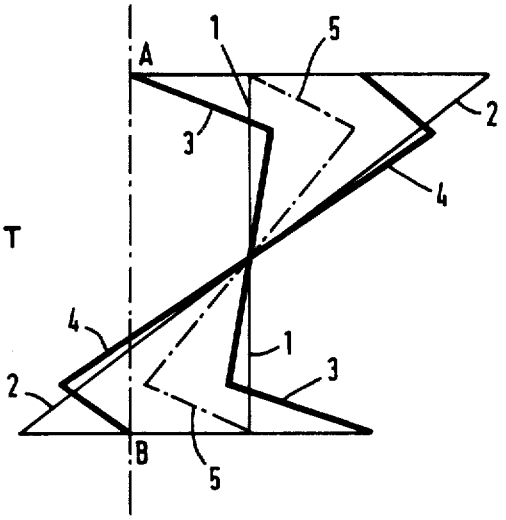
FIG.1 PRIOR ART

METHOD OF MANUFACTURING A METALLIC BELT OF HIGH STRENGTH, AND APPARATUS FOR USE IN SAID METHOD

This invention relates to a method of manufacturing a metallic belt having a high cyclical bending strength. The invention also relates to apparatus for use in said method.

Depending on the method of making an endless metallic belt, a certain stress distribution may be present in the belt in the radial direction thereof. If the belt is laid on a flat substrate, it will commonly assume a circular shape. If the belt has been made, for example, by welding the ends of a straight strip of metal together, or by rolling an endless strip of metal, the stress distribution in the circular belt will be such that the belt tends to assume a linear form throughout its length. In each radial longitudinal section, there will be a neutral (circular) line, on the inside of which compressive stresses will be present in the circular belt, and on the outside of which tensile stresses will be present in the belt. The compressive and tensile stresses will generally increase in proportion to the distance from the neutral line.

If the endless metallic belt has been stretched in circular form with plastic deformation, or has been annealed in this shape, the circular belt will, generally speaking, be free of tensile or compressive stresses.

When an endless metallic belt is used as a drive belt or a part thereof, as described for example in U.S. Pat. Nos. 3,604,283 and 3,720,113, it is of great importance that the belt has a very high cyclical bending strength, in particular if the belt is used as an endless transmission member or drive belt, or as a part thereof, of an infinitely variable pulley transmission, in which the travelling diameter of the belt over the pulleys varies greatly. The travelling diameter over the pulleys, in particular the smallest that is used, is a fraction of the diameter of the belt in its circular form.

However, the belt must be capable of withstanding the cyclical bending loads to which it is subjected under the desired tensile force both in the straight part and in the part curved with the smallest radius applied. The magnitude of this tensile force imposes a limitation on the permissible cyclical bending load and hence on the smallest radius that can be used. In order to meet these requirements the belt may be pre-bent, i.e., in the manufacture of the belt it may be bent at such a radius as to induce plastic deformation in the outer zones of the belt. Such a method is described in British Pat. No. 931,161.

Owing to this treatment, additional tensile and compressive stresses will be present in the belt when it assumes a circular form, these stresses being such that the belt tends to curve with a radius shorter than the radius of the circular form. As a consequence of the compressive stress in the zone radially outside the neutral line, the material in that zone will be able to withstand higher cyclical bending stresses, as the average tensile stress here is decreased by the compressive stress that is present. In the zone within the neutral line, the tensile stress present will increase the average tensile stress, which in this zone is generally less than that outside the neutral line. The tensile stress present within the neutral line imposes a limitation on the extent to which the material may be plastically deformed, and hence on the improvement in cyclical bending strength of the belt that can be obtained.

It is an object of the present invention to provide a method of manufacturing an endless metallic belt in which the strength of the belt when used as a drive belt, or as part of a drive belt, is considerably increased relative to a belt pre-bent by a conventional technique.

According to one aspect of the present invention, there is provided an improved method of manufacturing an endless metallic belt, which comprises bending said belt at such a radius as to produce plastic deformation in the metal to introduce a stress gradient in the radial direction of said belt, the improvement being that the belt is first subjected to tensile stress, which stress is maintained during the bending process.

In a preferred embodiment of the method according to the invention, the tensile force during the bending process is of such a magnitude that no plastic deformation occurs at the radially inner side of the belt at all.

The stress distribution within the belt as a result of the application of the method according to this invention will be described in more detail in the following description with reference to the accompanying drawings.

In one form of the method according to the invention the bending of the belt under a tensile force is accomplished by applying the belt around at least two tension rollers of relatively large diameter, moving the rollers away from each other, and subsequently displacing a bending roller of relatively small diameter against an initially straight part of the belt so that the belt runs over said bending roller at a sufficiently small angle to effect plastic deformation in the belt, with at least one of the rollers being driven. In this way a tensile stress is introduced in the belt before plastic deformation occurs in the part of the belt cooperating with the bending roller.

The extent of plastic deformation can be controlled by the selection of the bending roller and the tensile stress to be produced in the belt. In a preferred embodiment of the method according to the invention, the displacement of the bending roller causes the two tension rollers to be moved towards each other to a predetermined spaced relationship, whereafter the bending roller is displaced further to a pre-determined position without substantially altering the spacing between the tension rollers, so that the belt is elastically stretched to a pre-determined length during the bending process.

According to a further aspect of the present invention, there is provided apparatus for introducing a stress gradient in radial direction in an endless metallic belt, said apparatus comprising a bending roller over which the belt can be passed to effect plastic deformation thereof, characterized by at least two co-planar tension rollers of relatively large diameter, by means for forcing said tension rollers away from each other, and by means for radially displacing the bending roller is in the same plane.

According to another feature of the present invention, abutments are provided for limiting the minimum spacing between the tension rollers, and the displaceability of the bending roller is limited to a predetermined position, so that the length of the belt is kept constant during the bending process.

In explanation of the invention, the stress distribution in a metallic belt and one exemplary embodiment of apparatus for providing a stress gradient will be further elucidated with reference to the accompanying drawings.

Figure 2:
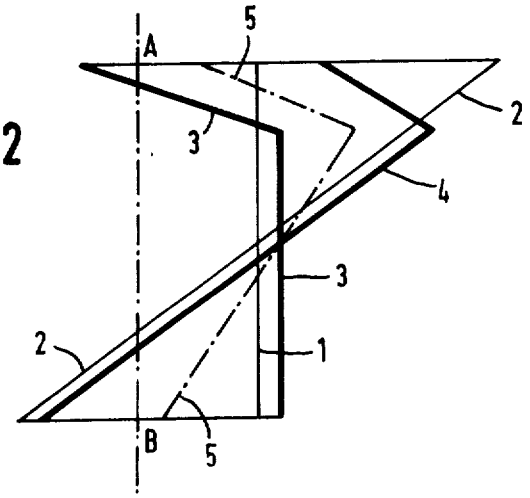
Figure 3:
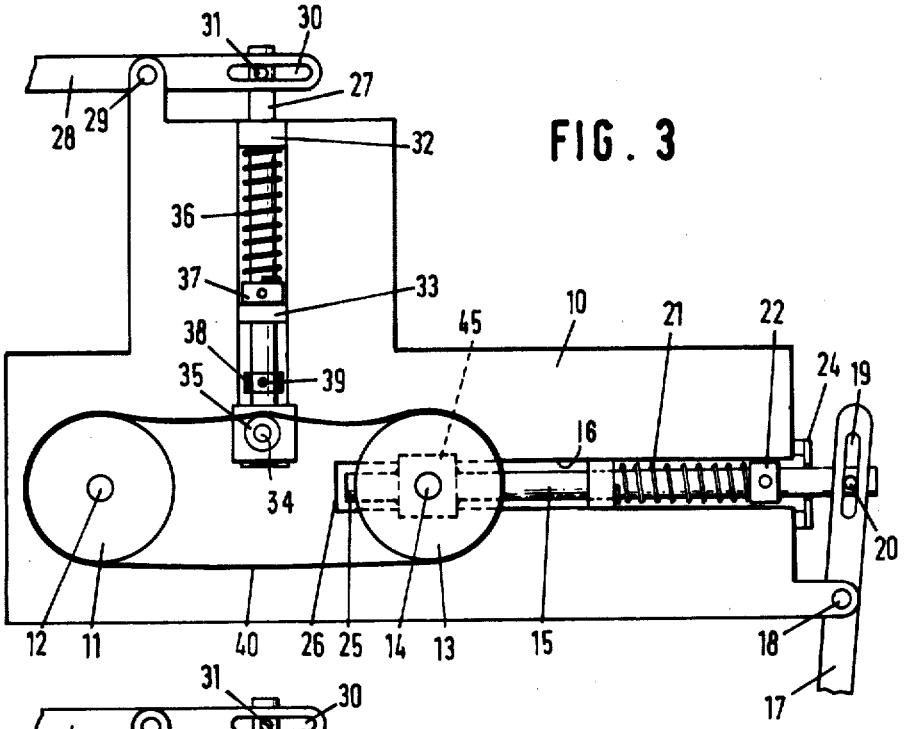
Figure 4:
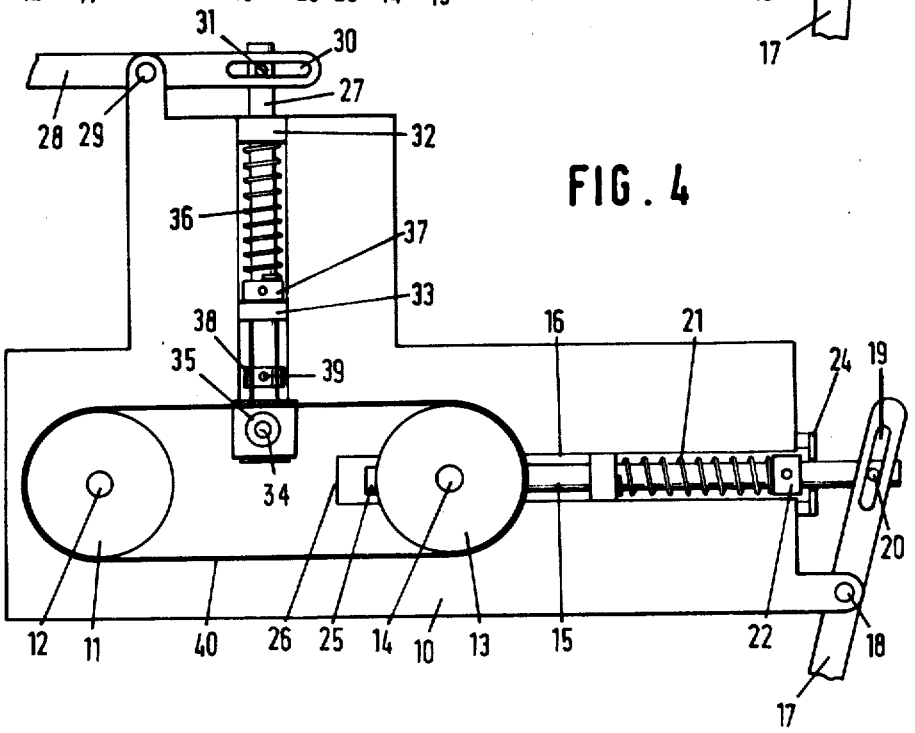
Figure 5:
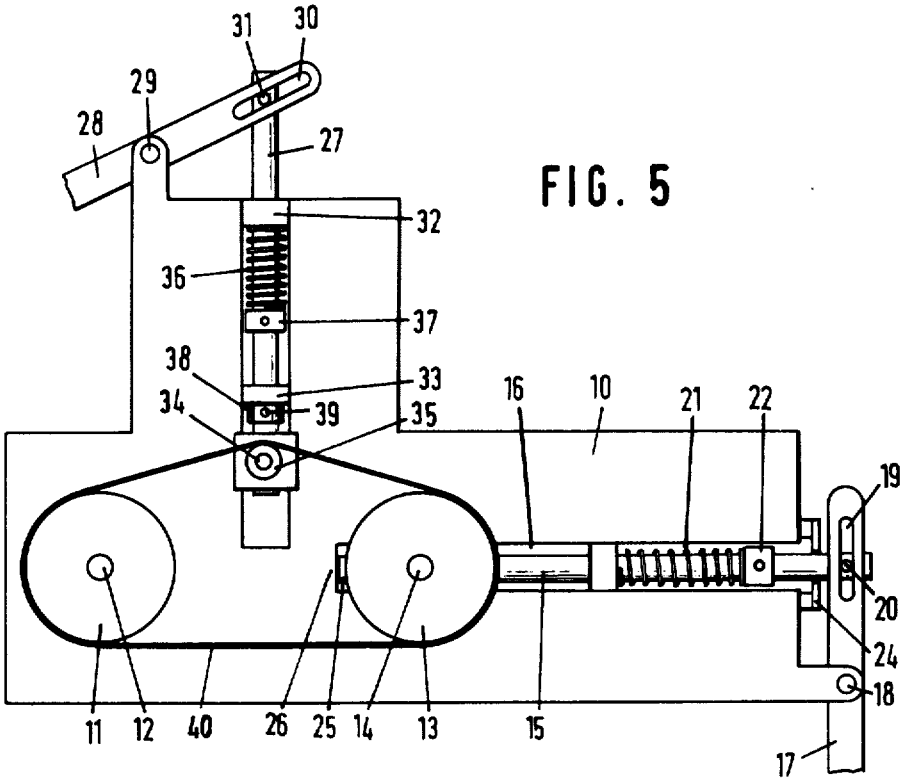

In said drawings,

FIGS. 1 and 2 are diagrams showing the stress distribution in the radial direction of a metallic belt: and FIGS. 3, 4 and 5 are diagrammatic elevational views of apparatus for producing a stress gradient in an endless metallic belt.

Referring first to FIGS. 1 and 2, FIG. 1 shows stress distributions in a belt pre-bent without tensile force, and FIG. 2 shows stress distributions in a belt pre-bent with tensile force in accordance with the present invention. In both figures the starting point is an endless belt in which each portion that is in the straight position is free of stresses. Such a belt is obtained, for example, after a rolling treatment, or by welding the ends of a straight strip of metal together.

FIGS. 1 and 2 illustrate the stress distributions along a line A–B, being a line through the metal perpendicular to the surface of the material. Points A and B are respectively located in the radially outer and inner surfaces of the belt.

Each of FIGS. 1 and 2 shows five curves 1–5, the perpendicular distance between a point of a curve and line A–B being indicative of the magnitude of the stress. Tensile stresses are plotted on the right-hand side of line A–B and compressive stresses on the left-hand side. The stress distributions are shown for a belt that is under a tensile force and runs over two pulleys, so that it is alternately straight and curved.

Curves 1 and 2 (both drawn in thin lines) illustrate the stress distributions in a belt not pre-bent with plastic deformation, respectively when, under a tensile force, the belt is drawn straight (in the straight part) and is curved (on the pulley).

Curves 3 and 4 (both drawn in heavy lines) show the stress distributions in a belt pre-bent with plastic deformation, respectively, when, under a tensile force in actual use, the belt is drawn straight (in the straight part) and is curved (on the pulley). The dot-dash line 5 shows the average stress, which, in particular at the surface of the material, should be as low as possible in order to increase the cyclical bending strength of the belt.

The stress distributions shown in FIG. 1, curves 3, 4, apply to a belt pre-bent so as to produce plastic deformation at both the radially outer surface (point A) and the radially inner surface (point B). The average stress experienced by a non pre-bent belt is not shown in FIG. 1 but is the average of lines 1 and 2. Comparison of this average stress with curve 5 (the average stress of a pre-bent belt) shows that pre-bending the belt decreases the average stress (and hence increases the cyclical bending strength) at the outer surface, and increases the average stress (and hence decreases the cyclical bending strength) at the inner surface. The strength of the belt is optimal if the inner and outer surfaces are of equal bending strength. Or, the amplitudes of the cyclical deviations for the two surfaces being equal, if the average stress is the same at the inner and outer surfaces.

The stress distributions shown in FIG. 2, curves 3 and 4, apply to a belt that has been pre-bent under a tensile force in accordance with the present invention, and this in such a manner that no plastic deformation has been effected at the radially inner surface (point B). Just as in FIG. 1, curves 3 and 4 respectively show the stress distribution when in use in the straight part of the belt and in the part curved on the pulley. FIG. 2 clearly shows that in the belt pre-bent in accordance with the present invention, the average stress (curve 5) at the surfaces of the belt (point A and B) may be considerably lower than the average stress at the surfaces of a belt which is pre-bent in accordance with the prior art (see curve 5, FIG. 1). Therefore, the cyclical bending strength of the belt is considerably increased by the present invention.

The stress distribution that is required for a given purpose can be achieved by proper selection of the tensile force during the bending process and of the diameter of the bending roller. This selection depends, among other factors, on the material used, the required resistance to fatique, the thickness of the belt, the diameters of the pulleys over which the belt is to run, and the possible variation of these diameters in an infinitely variable pulley transmission.

Referring now to FIGS. 3–5, these figures each show a similar elevational view of apparatus for introducing a stress distribution in an endless metallic belt in accordance with the present invention. In the three figures, corresponding parts are designated by the same reference numerals.

The apparatus shown in FIGS. 3–5 comprises a frame 10, on which a tension roller 11 is mounted for rotation. Roller 11 is fixedly mounted on a shaft 12, which is journalled in frame 10 and can be driven, for example, by means of an electric motor not shown. A second tension roller 13 is mounted for free rotation on shaft 14, secured to a sliding block 45 that is slidable in frame 10 and connected to a rod 15 that is movable in the direction of its longitudinal axis. When rod 15 is moved in its longitudinal direction tension roller 13, which is co-planar with tension roller 11, is moved radially towards and away from roller 11. Rod 15 is accommodated in a recess 16 of frame 10 and can be displaced by means of a lever 17, which may be operable by hand, for example. Lever 17 pivots about a pin 18 secured to frame 10, and has a slot 19 for receiving a pin 20 of rod 15. Surrounding rod 15 is a biased spring 21 which at one end rests against a shoulder 22 of rod 15 and at its other end rests against a sliding block for rod 15, which is welded to frame 10. The maximum length of spring 21 is limited by an abutment 24 secured to frame 10, and against which shoulder 22 of rod 15 can rest. Rod 15 is then in its extreme right-hand position (as viewed in the Figures), which position is shown in FIG. 4. The other extreme position of rod 15, shown in FIG. 5, in which tension rollers 11 and 13 are spaced the smallest distance apart, is reached when the end 25 of rod 15 rests against the end 26 of recess 16. Lever 17 enables roller 13 to be moved towards roller 11 against the pressure of spring 21.

A further rod 27 is movable in frame 10 by means of a lever 28. Lever 28 is operable, for example, by hand, to pivot about a pin 29 secured to frame 10. Lever 28 has a slot 30 receiving a pin 31 of rod 27, so that when lever 28 is operated rod 27 is displaced in its longitudinal direction, guided by guide blocks 32 and 33 secured to frame 10. Rod 27 carries a shaft 34, extending at right angles to it, and around which a bending roller 35 can freely rotate. Bending roller 35 is co-planar with tension rollers 11 and 13, and can be displaced in that plane by movement of rod 27. A compression spring 36 is mounted around rod 27 to rest with one end against guide block 32 and with its other end against a shoulder 37 of rod 27. Spring 36 has sufficient force for it to push shoulder 37 against guide block 33 when lever 28 is not operated. In that situation, bending roller 35 is intermediate tension rollers 11 and 13 (shown in FIG. 3). Rod 27 is further provided with an annular abutment 38, which is mounted for movement on rod 27 and can be fixed to the latter at a desired position, for example, by means of a bolt 39. In the uppermost position (shown in FIG. 5) of rod 27, abutment 38 rests against guide block 33.

The operation of the apparatus is as follows. By means of lever 17, tension roller 13 is moved towards tension roller 11 against the action of spring 21, whereafter an endless metallic belt 40 is laid around rollers 11 and 13. This situation is shown in FIG. 3. In it, rod 27 is pressed down (as viewed in the figure) by spring 36.

When belt 40 has been laid around rollers 11 and 13, lever 17 is released, and belt 40 is tensioned taut by the action of spring 21, and this at such a force that when belt 40 is contacted with bending roller 35, plastic deformation at the radially inner side of belt 40 is limited or even avoided. This situation is shown in FIG. 4. Next tension roller 11 is driven for rotation, for example by means of an electric motor not shown, so that the tensile force is uniformly distributed over the length of belt 40.

As tension rollers 11 and 13 rotate, lever 28 is operated to press bending roller 35 against belt 40 and subsequently displace it further until abutment 38 rests against guide block 33. During this movement tension roller 13 is pressed by belt 40 towards roller 11 against the action of spring 21. Before abutment 38 contacts guide block 33, the end 25 of rod 15 will rest against surface 26, and subsequently belt 40 will be elastically stretched to a pre-determined value when abutment 38 contacts guide block 33 and the desired tensile stress is present in belt 40. Accordingly in the situation depicted in FIG. 5, all rollers have assumed a pre-determined position, in which belt 40 is pre-curved with plastic deformation, effected as belt 40 runs over bending roller 35.

The apparatus can be adjusted for treating belts of different lengths by displacing abutment 38 relative to rod 27.

I claim:

1. A method for improving the cyclical bending strength of an endless metallic belt, said method comprising:

subjecting said belt to tensile stress by applying a predetermined tensile force in the longitudinal direction; then applying a lateral force to said belt in the radially outward direction by means having such a radius as to introduce a radial stress gradient and produce a plastic deformation in said belt; and maintaining said tensile force on said belt while applying said lateral force, the tensile stress being such that no plastic deformation occurs at the radially inner side of said belt.

2. The method according to claim 1 and comprising the further steps of:

applying said belt around at least two tension rollers of relatively large diameter;

moving said rollers away from each other; and rotating at least one of said rollers;

said lateral force being applied by means of a bending roller of relatively small diameter bearing against the inner side of an initially straight part of said belt so that said belt runs over said bending roller at a sufficiently small angle to effect plastic deformation of said belt.

3. The method according to claim 2 and comprising the further steps of:

causing the two tension rollers to be moved toward each other to a pre-determined spaced relationship by displacing said bending roller; and then further displacing said bending roller to a predetermined position without substantially altering the spacing between the tension rollers, so that said belt is elastically stretched to a predetermined length during the bending process.

4. Apparatus for pre-bending an endless metallic belt, said apparatus comprising:

a frame;

at least two spaced co-planar tension rollers of relatively large diameter mounted for rotation to said frame;

a bending roller mounted for rotation to said frame at a point substantially intermediate said tension rollers, said belt passing over said tension and bending rollers;

means mounted to said frame for forcing said tension rollers away from each other to create longitudinal tensile stress in said belt; and means mounted to said frame for displacing said bending roller against the flat inner side of said belt after said belt has been subjected to the longitudinal tensile stress, thereby introducing a radial stress gradient and pre-bending said belt in a radial direction.

5. The apparatus of claim 4 and further comprising:

abutments mounted on said frame for limiting the minimum spacing between said tension rollers; and means mounted to said frame for limiting the displacement of said bending roller to a predetermined position.

* * * * *